United States Patent [19]

Rohner et al.

[11] 4,314,437

[45] Feb. 9, 1982

[54] SPLICING DEVICE

[75] Inventors: Joachim Rohner; Heinz Zumfeld, both of Mönchengladbach, Fed. Rep. of Germany

[73] Assignee: W. Schlafhorst & Co., Mönchengladbach, Fed. Rep. of Germany

[21] Appl. No.: 114,883

[22] Filed: Jan. 24, 1980

[30] Foreign Application Priority Data

Jan. 26, 1979 [DE] Fed. Rep. of Germany ..... 2902988

[51] Int. Cl.[3] ..... B65H 69/06

[52] U.S. Cl. ..... 57/22; 57/261

[58] Field of Search ..... 57/22, 23, 78, 80, 81, 57/261, 263, 264; 28/141; 73/160; 242/35.6

[56] References Cited

U.S. PATENT DOCUMENTS

| | | | |
|---|---|---|---|
| 3,220,758 | 11/1965 | Raasch et al. | 73/160 X |
| 3,572,025 | 3/1971 | Irwin | 57/22 |
| 3,581,486 | 6/1971 | Dibble | 57/22 |
| 4,178,749 | 12/1979 | Stahlecker | 57/263 |
| 4,217,749 | 8/1980 | Rohner et al. | 57/22 X |
| 4,240,247 | 12/1980 | Matsui et al. | 57/22 X |

*Primary Examiner*—Donald Watkins

*Attorney, Agent, or Firm*—Herbert L. Lerner

[57] ABSTRACT

Splicing assembly, including a splicing device having a pneumatic thread splicer for joining an upper thread to a lower thread and a testing device for monitoring the tensile strength of the splice.

9 Claims, 2 Drawing Figures

SPLICING DEVICE

Figures 1, 2:
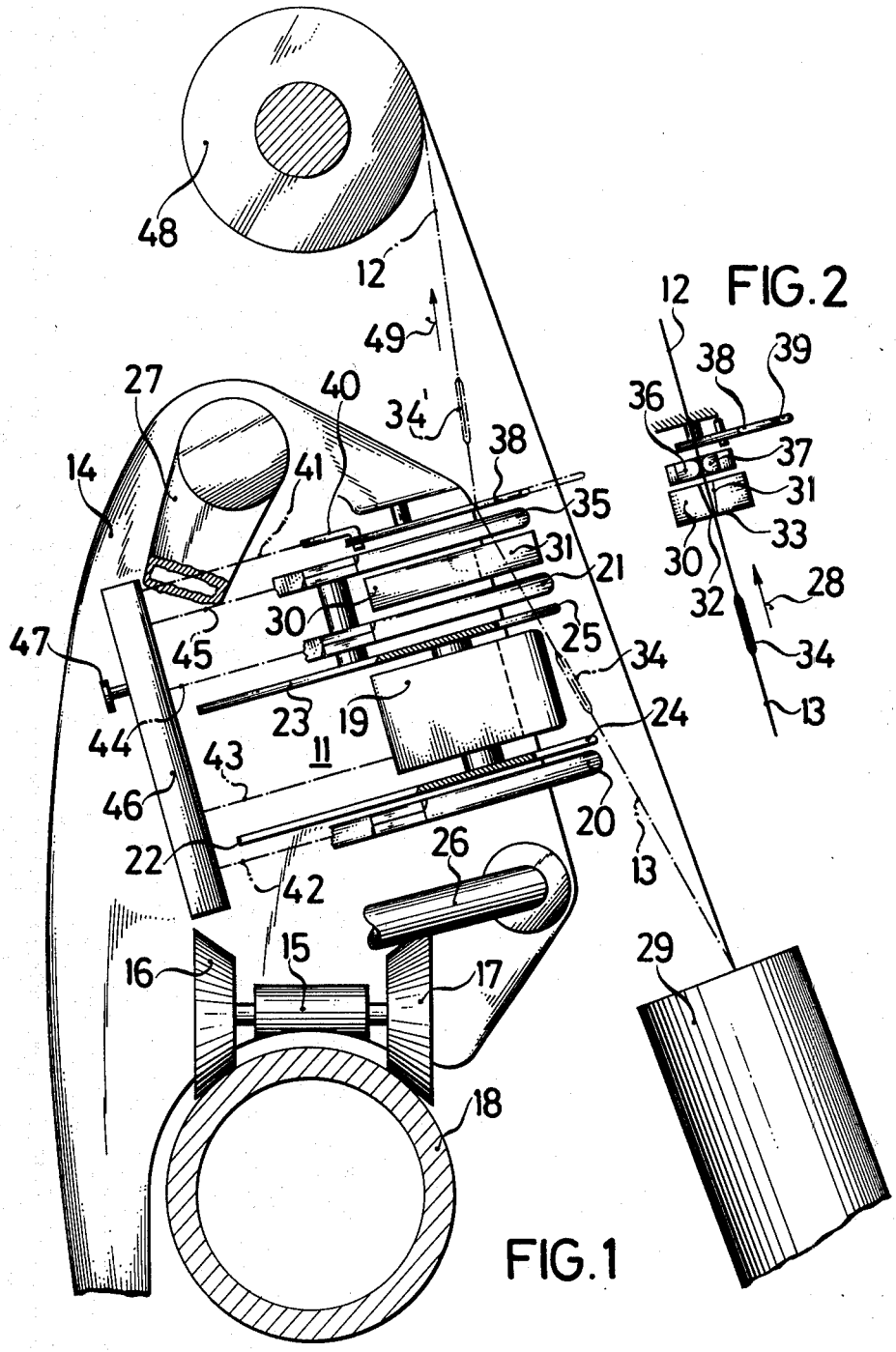

The invention relates to a splicing device with a pneumatic thread splicer for tying an upper thread to a lower thread. It has already been proposed to equip such a thread splicer with a thread clamp for the upper thread and a thread clamp for the lower thread, to make the spliced joint.

The thread clamps are operative for the duration of the splicing process and are inoperative as soon as the splicing operation is completed. Such a device is shown in co-pending allowed U.S. Patent Application Ser. No. 020,099, filed Mar. 13, 1979, now U.S. Pat. No. 4,232,509, of which the inventors of the instant application are co-inventors.

The splicing devices that have become known to date do not guarantee that the spliced joint has the strength required for further processing in every case.

It is accordingly an object of the invention to provide a splicing device which overcomes the hereinafore mentioned disadvantages of the heretofore known devices of this general type, and to ensure that the spliced joint made by the splicing device has the desired strength which is necessary for the further processing of the thread joined together by splicing.

With the foregoing and other objects in view there is provided, in accordance with the invention, a splicing assembly, comprising a splicing device including a pneumatic thread splicer for joining an upper thread to a lower thread and a testing device for monitoring the tensile strength of the splice. The invention has two decisive advantages. If the spliced joint was made properly, it becomes stronger through the use of a testing device, i.e. through stress in tension. If, on the other hand, the spliced joint was not made properly, the two thread ends are pulled apart again under stress in tension, and the splicing operation can be repeated. In practice, the invention has had the surprising effect that always only the two just-mentioned cases have occurred. Either the spliced joint became stronger or the joint could be pulled apart.

In accordance with another feature of the invention, the splicing device has a thread output side, and the testing device is disposed at the thread output side of the splicing device.

In accordance with a further feature of the invention, the testing device is fastened to the splicing device.

In accordance with an additional feature of the invention, there is provided another testing device for monitoring thread dimension, the other testing device being disposed at the thread output side of the splicing device. This is advantageous since it may happen that a double thread is inserted in the splicing operation, remaining thread ends are improperly cut or spliced joints with unfavorable dimensions are produced. The testing device is then also capable of monitoring thread defects of this kind and of severing the thread at the faulty point.

In accordance with an added feature of the invention, the other thread testing device has a thread output or run-off side, and the first-mentioned thread testing device is disposed at the thread output side of the other thread device. If at this point the thread dimension is already improper, then it becomes unnecessary to test the spliced joint for tensile strength.

In accordance with yet another feature of the invention, the splicing device comprises guide means for briefly conducting the threads into at least one of the testing devices after splicing.

In accordance with yet a further feature of the invention, the testing device comprises a thread tensioner.

In accordance with yet an additional feature of the invention, the testing device comprises a controlled thread clamp.

In accordance with a concomitant feature of the invention, there are provided control means for operating the testing device exclusively (or only) during a start-up phase after splicing.

The invention is advantageously suitable for joining upper thread and lower threads of any kind. The terms "upper thread" and "lower thread" are not tied to the terms "top" and "bottom". Rather, a thread is designated as a lower thread if it comes from a thread supply joint, for instance from a supply coil, a thread generator or a thread accumulator. An upper thread is a thread going to a thread receiving point such as a pick-up coil, a winding beam or a processing machine, for instance. The travel direction of the thread can be from the bottom up or also in the opposite direction and can in general take any desired course such as horizontally, for instance.

The new splicing device is intended primarily as a traveling device. Thus, if the device travels transversely to a warp, for instance, the ends of this warp can be connected to the beginnings of threads of a new warp, each spliced joint being tested sucessively. The splicing device can also travel from work station to work station in a winding machine or a spinning frame and join the threads together there. However, it can also be disposed at each work station as a single unit. Another possibility would be to make the splicing device a travelling unit and to make the testing device stationary.

Other features which are considered as characteristic for the invention are set forth in the appended claims.

Although the invention is illustrated and described herein as embodied in a splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a simplified, fragmentary and diagrammatic side-elevational view of the device according to the invention; and FIG. 2 is a fractional front-elevational view of the device of FIG. 1, partly broken away.

Referring now to the figures of the drawing as a whole, there is seen a splicing assembly including a splicing device, designated overall with reference numeral 11, for joining an upper thread 12 to a lower thread 13. As mentioned hereinbefore, the terms "upper" and "lower" do not necessarily mean "top" and "bottom". The splicing device 11 comprises a machine frame 14 which supports a truck 15. The truck 15 has rollers 16 and 17 by means of which the splicing device 11 can be moved on a support tube 18. Also seen at the splicing device 11, is a pneumatic thread splicer 19, a controllable thread clamp 20 for the lower thread 13, a controllable thread clamp 21 for the upper thread 12, a lower side plate 22 with a thread guiding slot 24 and an upper side plate 23 with a thread guiding slot 25. Further provided is a hinged or pivotable suction tube 26 for the purpose of putting the lower thread 13 in place, and a further hinged or pivotable suction tube 27 for the purpose of placing the upper thread 12 in the pneumatic thread splicer 19. Both suction tubes are shown broken off. The detailed function thereof may be seen from the hereinafore-mentioned U.S. Patent Application Ser. No. 020,099.

The travel direction of the thread is designated by an arrow 28. The lower thread 13 comes from a thread supply device 29. Such thread supply devices may be of different kinds. They may be a work station of a spinning frame, the supply coil of a winding machine or a thread accumulator of a general type. At the splicing device 11, a thread input side and a thread output or run-off side are distinguished. In the travel direction of the thread, the thread input side is located under the thread splicer 19 and the thread output side is located above the thread splicer 19. On the thread output side of the splicing device, a testing device 30 for monitoring the dimension of the thread is disposed. The active part of this testing device includes a calibrated slot 31 with sharp lower edges 32, 33. Any thickening of the thread or the splice 34 exceeding the calibration is seized and held back by the lower edges of the calibrated slot. The thread is then severed or torn off at the lower edges by the pull of the thread.

A testing device 35 for monitoring the tensile strength of the splice 34 is disposed on the thread output side of the testing device 30 for monitoring the dimension of the thread. The testing device 35 includes a controlled two-part thread clamp, the two parts of which are designated with reference numerals 36 and 37.

The splicing device 11 further includes a guide element 38 which briefly conducts the thread 12, 13 into the testing devices 35 and 30 after the splice 34 is made. This guide element 38 has a pivoted hook 39 which can be actuated by a rod 40. The rod 40 establishes an operative connection 41; the thread clamp 20 an operative connection 42; the thread splicer 19 an operative connection 43; the thread clamp 21 an operative connection 44; and the testing device 35 an operative connection 45; to a control device 46. The control device 46 is a stepping mechanism which can be set in operation by pressing a key 47, which is not shown in detail. Such conventional stepping mechanisms work with cams, for instance; the operating connections are then mechanical switching elements such as levers or the like.

The upper thread 12 leads to a thread take-up device 48. This may be a thread pick-up device of a general type, such as a textile machine, a beam, or as in the present case, a coil, for instance. The thread take-up device imparts a tension to the thread. The magnitude of the tension depends on the testing device 35, if the guide element 38 is inserted. The two parts 36, 37 of the thread clamp of the testing device can be applied against the thread with adjustable pressure.

In the splicing operation described in detail in the hereinafore mentioned Patent Application Ser. No. 020,099, the splicing device 11 grips the upper thread 12 and places it in the thread clamp 21 and the thread splicer 19. The same procedure is performed with the lower thread 19, i.e. it inserts it into the thread clamp 20 and the thread splicer 19. Thereupon, both threads are joined by splicing by feeding in compressed air. Prior to the splicing, the guide element 38 was switched-in, under the control of the device 46. The guide element 38 grips the upper thread 12, so that the course of the thread shown by the dot-dash line in FIG. 1 is obtained after the thread clamp 20, 21 is opened. The running thread is then conducted through the testing device 30 and the testing device 35. While the thread take-up device 48 pulls the thread in the direction of the arrow 49, the testing device 35 exerts a previously adjusted braking effect on the thread. This is accomplished by spring pressure. The control is preferably exerted so that the action on the thread begins only when the course of the thread shown by dot-dash lines is reached. The testing device 35 remains switched-on until the splice 34 has passed the testing device 30 as well as the testing device 35. As a rule, the splice 34 passes both testing devices without taking the thread or the splice apart. If, however, the splice had turned out to be abnormal, because, for instance, a double thread had been formed, then the thread would have been severed already by the testing device 30.

If, on the other hand, the splice 34 has normal dimensions, it passes the calibrated slot 31 of the testing device 30 unimpeded and without being stressed. After leaving the testing devices 30 and 35, the splice 34 finally occupies the position 34' indicated in dot-dash lines. There, the tensile stress adjusted by the testing device 35 is now fully effective. If the splice does not have the required strength, it is pulled apart. The connection of the threads is then dissolved. Since the thread tension is customarily monitored in a textile machine, a thread brake is immediately activated so that even in this case the splicing of the two threads can be repeated. After the testing device 35 and the guide element 38 are switched off, the thread assumes the position shown by the solid line in FIG. 1, if the splice has been made properly.

The invention is not limited to the embodiment example shown and described. It can be achieved by a slight change in construction in that the thread is conducted during the testing only by the testing devices themselves and not additionally through parts of the splicing device as well. On the other hand, it would do no harm to the testing operation if the thread also ran through the thread splicer 19 during testing; with the thread clamps 20 and 21 open, however.

The embodiment example relates to a splicing device which travels from work station to work station of a textile machine. However, it could also be stationarily disposed and could, for instance, be assigned to each individual thread for each work station of a textile machine. In that case, the thread could take the course indicated in dot-dash lines in FIG. 1 during operation. The testing device 35 would then only be inserted during testing; during normal operation, however, it would be switched off and would no longer exert a braking effect on the thread.

A simple device with mechanical action was chosen as the testing device for monitoring the dimension of the thread in the embodiment example. Electronic devices which could be used equally well are also known. Such testing devices monitor the thread electrooptically or capacitively.

There are claimed:

1. Splicing assembly, comprising a splicing device including a pneumatic thread splicer for joining an upper thread to a lower thread and a testing device for monitoring the tensile strength of the splice.

2. Splicing assembly according to claim 1, wherein said splicing device has a thread output side, and said testing device is disposed at said thread output side of said splicing device.

3. Splicing assembly according to claim 1 or 2, wherein said testing device is fastened to said splicing device.

4. Splicing assembly according to claim 2, including another testing device for monitoring thread dimension, said other testing device being disposed at said thread output side of said splicing device.

5. Splicing assembly according to claim 4, wherein said other thread testing device has a thread output side, and said first-mentioned thread testing device is disposed at said thread output side of said other thread testing device.

6. Splicing assembly according to claim 4 or 5, wherein said splicing device comprises guide means for briefly conducting the threads into at least one of said testing devices after splicing.

7. Splicing assembly according to claim 1, wherein said testing device comprises a thread tensioner.

8. Splicing assembly according to claim 1, wherein said testing device comprises a controlled thread clamp.

9. Splicing assembly according to claim 1, including control means for operating said testing device exclusively during a start-up phase after splicing.

* * * * *